US005194143A

United States Patent [19]

Roling

[11] Patent Number: 5,194,143

[45] Date of Patent: Mar. 16, 1993

[54] METHOD FOR INHIBITING FOULING IN CAUSTIC SCRUBBER SYSTEMS

[75] Inventor: Paul V. Roling, Spring, Tex.

[73] Assignee: Betz Laboratories, Inc., Trevose, Pa.

[21] Appl. No.: 793,754

[22] Filed: Nov. 18, 1991

[51] Int. Cl.[5] ..... C10G 21/16; C10G 21/12; C10G 29/22; C10G 29/20

[52] U.S. Cl. ..... 208/291; 208/48 R; 208/48 AA; 208/290; 423/245.1; 585/950

[58] Field of Search ..... 208/48 AA, 48 R, 290, 208/291; 423/245.1, 245.2; 585/950

[56] References Cited

U.S. PATENT DOCUMENTS

| | | | |
|---|---|---|---|
| 3,793,187 | 2/1974 | Marx et al. | 208/289 |
| 4,673,489 | 6/1987 | Roling | 208/289 |
| 4,952,301 | 8/1990 | Awbrey | 208/48 AA |

*Primary Examiner*—Theodore Morris
*Assistant Examiner*—Walter D. Griffin
*Attorney, Agent, or Firm*—Alexander D. Ricci; Philip H. Von Neida

[57] ABSTRACT

A method for inhibiting the formation of polymeric based fouling deposits normally formed during the caustic washing to hydrocarbons is disclosed. The method comprises adding an effective amount for the purpose of an acetoacetate ester compound to the caustic wash system.

13 Claims, No Drawings

METHOD FOR INHIBITING FOULING IN CAUSTIC SCRUBBER SYSTEMS

FIELD OF THE INVENTION

The present invention pertains to methods for inhibiting the formation of fouling deposits in basic wash systems of the type adapted to scrub impurities from liquid or gas phase hydrocarbonaceous mediums.

BACKGROUND OF THE INVENTION

In cracking operations, such as the pyrolytic cracking of ethane, propane, and naphthas to form olefins, oxygenated compounds, including carbonyl compounds are formed, the amount of carbonyl compounds, such as aldehydes and ketones, formed in such operations can vary widely, but is typically about 1 to 100 parts per million in the gas stream with concentrations as high as 1000 parts per million, occasionally being encountered because of the utilization of various feedstocks and cracking temperatures.

When the gas stream is passed through a basic wash (pH>7) to remove acidic components such as hydrogen sulfide and carbon dioxide, oxygen containing compounds, such as the carbonyl functionality compounds, particularly acetaldehyde, will undergo polymerization in the presence of the basic wash or scrubbing conditions. In the wash tower, the resulting polymer will settle on the trays leading to fouling and eventual plugging of the trays, which means the unit must be shutdown for cleaning which can be a costly operation. The basic wash systems, where treatment is required to inhibit such polymer-based fouling, include amine acid gas scrubber, such as MEA, DEA, isopropyl amine, butyl amine, etc. and caustic wash systems.

Generally, the basic washing entails contacting the gaseous olefins with an aqueous basic solution in a wash tower to remove hydrogen sulfide, carbon dioxide and other oxygenated compounds therefrom. The basic washing is particularly appropriate for the basic washing process which follows the pyrolytic cracking of such hydrocarbons as ethane, propane, butane, naphtha and mixtures thereof to produce the corresponding gaseous ethylene, propylene, butadiene and the like, containing the carbonyl and other contaminants.

SUMMARY OF THE INVENTION

Acetoacetate ester compounds are used to inhibit polymer based fouling in basic (pH>7) wash systems of the type adapted to remove impurities from liquid or gas phase hydrocarbon mediums. As used herein, "acetoacetate ester compounds" signify any compound within the class defined by the formula $$CH_3COCH_2CO_2C_xH_y$$

wherein x is an integer of from 1 to about 8 and y is an integer from 3 to about 17.

DESCRIPTION OF THE RELATED ART

U.S. Pat. No. 4,673,489, Roling, June 1987 teaches that hydroxylamine and its hydrochloride and hydrogen sulfate salts can be used to inhibit polymer formation caused by the condensation reaction of aldehydes contained in caustic scrubber units.

U.S. Pat. No. 4,952,301, Awbrey, August 1990 teaches using ethylenediamine compounds to inhibit polymer formation in caustic wash systems.

U.S. Pat. No. 3,793,187, Marx et al., February 1974 discloses a process for removing carbonyl compounds from hydrocarbons. The method comprises adding an aqueous hydrazinium compound to the hydrocarbon and separating the aqueous layer from the purified hydrocarbon.

DETAILED DESCRIPTION OF THE INVENTION

The present invention relates to methods for inhibiting the formation of polymeric based fouling deposits during the basic washing of hydrocarbons contaminated with oxygenated compounds comprising adding an effective amount for the purpose to the wash an acetoacetate ester compound having the formula $$CH_3COCH_2CO_2C_xH_y$$

wherein x is an integer from 1 to about 8 and y is an integer from about 3 to about 17.

The treatment is particularly well suited for inhibition of polymer based deposits formed during the caustic scrubbing of gas phase olefinic hydrocarbons resulting from pyrolytic cracking processes. Such gas phase olefinic hydrocarbon streams, when subjected to caustic wash systems would undergo aldol condensation of the carbonyl compounds, including ketone and aldehyde contaminants, and form insoluble polymers.

Aldehyde based polymer formation appears to be more prevalent and troublesome than those polymers formed by the ketone contaminants. It is desirable to provide an antifoulant treatment that exhibits selectivity for the aldehyde. Such selectivity appears to be exhibited by the acetoacetate ester compounds of the present invention.

The preferred acetoacetate ester compound is ethyl acetoacetate. The fouling inhibitors can be added to the caustic as neat materials or in solution form. The preferred method of addition is as an aqueous solution.

Although applicant is not to be bound to any particular theory of operation, it is believed that the acetoacetate ester compounds form a complex with the adehyde-type contaminants and that the resulting complex does not undergo polymerization. One possible reaction in accordance with the theory is as follows:

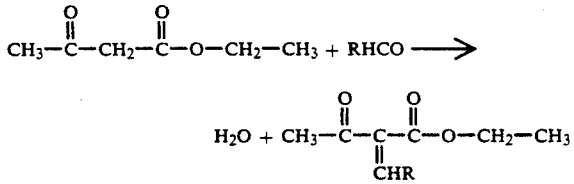

Similar reactions are postulated for the other acetoacetate ester compounds encompassed by the above formula.

One mole of the acetoacetate ester compound is needed for every one mole of aldehyde. The acetoacetate ester compound should be added to the caustic wash in an amount from about 0.5 to about 10 moles per mole of aldehyde. Preferably, the feed rate ranges to from 1 about 3 moles of acetoacetate ester compound per mole of aldehyde, with a 1.0 mole ratio being especially preferred.

The acetoacetate ester compound should be added to the basic wash in a quantity to assure that the molar amount of acetoacetate ester is sufficient to react with all the undesirable carbonyl contaminants. The present method entails assuring that a sufficient amount of acetoacetate ester compound is present in the basic wash system. The treatment range for the addition of the acetoacetate ester compound to the basic wash system clearly depends upon the severity of the level of impurities in the hydrocarbon to be washed. Broadly speaking, from about 1 to about 10,000 parts per million acetoacetate ester compound per million parts basic wash is a sufficient treatment range if no convenient method of measuring carbonyl level is available.

The treatment is especially well adapted to inhibit polymer based fouling in caustic wash systems wherein gaseous olefinic compounds are washed. These gas phase olefins comprise ethylene, propylene, butadiene, etc., which are formed from the pyrolytic cracking of hydrocarbon feedstocks such as ethane, propane, butane, naphtha, or mixtures thereof. The invention may be utilized in any alkaline-based wash system but is particularly useful in caustic washes such as sodium hydroxide, potassium hydroxide, and in some of the other organic caustic materials.

The data set forth below demonstrate the unexpected results occasioned by use of this invention. The following examples are included as being an illustration of the invention and should not be construed as limiting the scope thereof.

EXAMPLES

Example 1

10 ml of 10% aqueous (25 mmol) sodium hydroxide, 0.50 ml (5.4 mmol) vinyl acetate, and a specified amount of inhibitor were added to a test tube. Without the inhibitor, the vinyl acetate hydrolyzed to acetaldehyde and sodium acetate. The acetaldehyde underwent the aldol condensation reaction and in 2 minutes a yellow colored solution resulted. This solution turned cloudy in about 3 minutes and in several hours orange solids appeared.

Five different molar amounts of ethyl acetoacetate were tested in the above described test method. 11.5, 5.8 and 3.8 mmol quantities were tested and upon addition to the tube immediately turned the solution yellow. No cloudiness nor solids formation occurred in a period of 6 days. 1.9 and 1.0 mmol quantities of ethyl acetoacetate resulted in solids formation within a few hours.

The results of example I are indicative that the compounds of the present invention are effective at inhibiting polymer formation in basic solutions. The ineffective results at less than 0.5:1 molar ratios of ethyl acetoacetate:acetaldehyde offers support for the theorized reaction mechanism.

EXAMPLE II

Comparative testing of other activated hydrogen compounds such as acetonitrile, 2,4-pentanedione, and diethyl malonate was performed utilizing the test method described in Example I. 6.0 and 12.0 mmols is of acetonitrile eventually formed solids several hours after addition. 5.8 mmols of 2,4-pentanedione and 5.4 mmols of diethyl malonate also formed solids several hours after addition. These poor results contrast with the surprising results of the compounds of the present invention. The evidence that related activated hydrogen compounds were ineffective makes the use of acetoacetate esters all the more unobvious.

EXAMPLE III

A control of 10.0 ml of 10% aqueous sodium hydroxide and 0.30 ml (5.4 mmols) of acetaldehyde was mixed. This solution turned yellow in 7 minutes, cloudy in 21 minutes, followed by solids. 2.9 mmols and 5.4 mmols of ethyl acetoacetate were added to similar solutions and yellow color occurred immediately, but no cloudiness or solids formation after 18 hours. 6.0 mmols of acetonitrile and 5.8 mmols of 2,4-pentanedione allowed solids formation in similar solutions.

While this invention has been described with respect to particular embodiments thereof, it is apparent that numerous other forms and modifications of this invention will be obvious to those skilled in the art. The appended claims and this invention should be construed to cover all such obvious forms and modifications that are within the true spirit and scope of the present invention.

Having thus described the invention, what claim is:

1. A method for inhibiting the formation of polymeric based fouling deposits during the basic washings of olefin-containing hydrocarbons contaminated with oxygenated compounds comprising adding about 1 to about 10,000 parts per million parts wash to the wash acetoacetate ester compound having the formula $$CH_3COCH_2CO_2C_xH_y$$

wherein x is an integer from about 1 to about 8 and y is an integer from about 3 to about 17.

2. The method as claimed in claim 1 wherein said acetoacetate ester compound is ethyl acetoacetate.

3. The method as claimed in claim 1 wherein said acetoacetate ester compound is added to said wash in a carrier solvent.

4. The method as claimed in claim 3 wherein said carrier solvent is water.

5. The method as claimed in claim 1 wherein the hydrocarbon being washed is produced by the pyrolytic cracking of hydrocarbon feedstocks.

6. The method as claimed in claim 5 wherein said hydrocarbon feedstocks are selected from the group consisting of ethane, butane, naphtha, and mixtures thereof.

7. The method as claimed in claim 1 wherein the hydrocarbon being washed comprises an olefin contaminated with oxygen-containing compound impurities.

8. The method as claimed in claim 1 wherein the hydrocarbon being washed is in the gaseous phase.

9. The method as claimed in claim 1 wherein said oxygenated compounds are composed primarily of carbonyl compounds.

10. The method as claimed in claim 9 wherein said carbonyl compounds comprise aldehydes, ketones, or mixtures thereof.

11. The method as claimed in claim 1 wherein said acetoacetate ester compound is added to said wash in an amount representing a molar ratio of said acetoacetate ester compound to said oxygenated compounds of from about 0.5:1 to about 10:1.

12. The method as claimed in claim 11 wherein said molar ratio is about 1:1.

13. The method as claimed in claim 11 wherein said molar ratio is about 1:1 to about 3:1.

* * * * *